United States Patent [19]

Papajewski

[11] 3,955,517

[45] May 11, 1976

[54] DRAG LINK-TYPE FEEDING MECHANISM

[75] Inventor: Reinhold Papajewski, Buchig, Germany

[73] Assignee: The Singer Company, New York, N.Y.

[22] Filed: Sept. 18, 1975

[21] Appl. No.: 614,442

[52] U.S. Cl. ..... 112/210
[51] Int. Cl.[2] ..... D05B 27/22
[58] Field of Search ..... 112/210, 211, 203, 209

[56] References Cited

UNITED STATES PATENTS

| | | | |
|---|---|---|---|
| 2,119,492 | 5/1938 | Sauer et al. | 112/210 |
| 3,012,531 | 12/1961 | Engel | 112/210 |
| 3,082,723 | 3/1963 | Backlin | 112/210 |
| 3,426,712 | 2/1969 | Hanyu et al. | 112/210 |

*Primary Examiner*—H. Hampton Hunter
*Attorney, Agent, or Firm*—R. E. Smith; E. L. Bell; M. J. Breen

[57] ABSTRACT

A drag link feeding mechanism for a sewing machine having its feed stroke adjusting element in the form of a ring nested within and mounted on a supporting ring which in turn is easily and simply attached to the web of the sewing machine frame. This allows the mechanism to be simple and mechanically compact so that movements of force are minimized and work loads imposed on the mechanism by heavy fabric are taken up by large bearing surfaces.

5 Claims, 3 Drawing Figures

DRAG LINK-TYPE FEEDING MECHANISM

BACKGROUND OF THE INVENTION

This invention relates in general to sewing machines and, in particular, to the feeding mechanisms of the type shown in the U.S. Pat. No. 693,852 to Free and particularly adapted for commercial heavy-duty sewing machines.

In the sewing of heavy fabrics such as, for example, automobile upholstering, or heavy brocades, as in furniture upholstering, or in any industry where large amounts of heavy fabrics are utilized, the feed dog which is responsible for the movement of the fabric in a forward or reverse direction across the work bed of a sewing machine for the sewing operation, takes up a heavy work load which is then imposed on the feed bar and the link mechanism which cntrols the length and direction of the stitch of the machine. Often the working conditions are such that the fabric being pushed and pulled sometimes falls off the machine, thus imposing extremely large forces on the feed dog pulling the fabric across the work bed, which large forces are ultimately absorbed by the feed mechanisms within the machine with large moments imposed by the linkages on the bearings and shafts therein. Prior art machines, a typical example of which is the heavy duty type machine as shown in the Engel U.S. Pat. No. 3,012,531, compensated for such loads by utilizing heavy bearings located in heavy webs in the machine frame. Thus, as shown in the patent, the shaft 30 is housed in rather large bearings 32, journalled in the web of the machine frame with the toggle links 42 and 43 and bridge 33 imposing large moments of force on these bearings when the machine is sewing heavy fabric.

Also, in order to compensate for the forces imposed by the work load on the sewing machine, it has heretofore been necessary to provide a web in the machine frame strong enough to support a large bore to receive a large bearing so as to absorb the work forces thereon, especially when such forces are magnified by the lever action involved in the toggle and bridge, such as shown in the Engel patent, supra.

This invention, however, provides large bearing surfaces on the lever and links themselves by utilizing a supporting ring for a complementary ring-shaped feed stroke adjusting element which is anchored or fastened to the web of the machine bed by simple machine screws so that thick webs and large bores for large bearings and bearing loads have been eliminated. With this double ring arrangement, all of the levers and toggles necessary to function as a drag link feeding mechanism can be made compact, thus reducing the bearing forces and moments of force while at the same time providing a larger bearing surface for these forces.

DESCRIPTION OF THE PREFERRED EMBODIMENT

Figure 1:
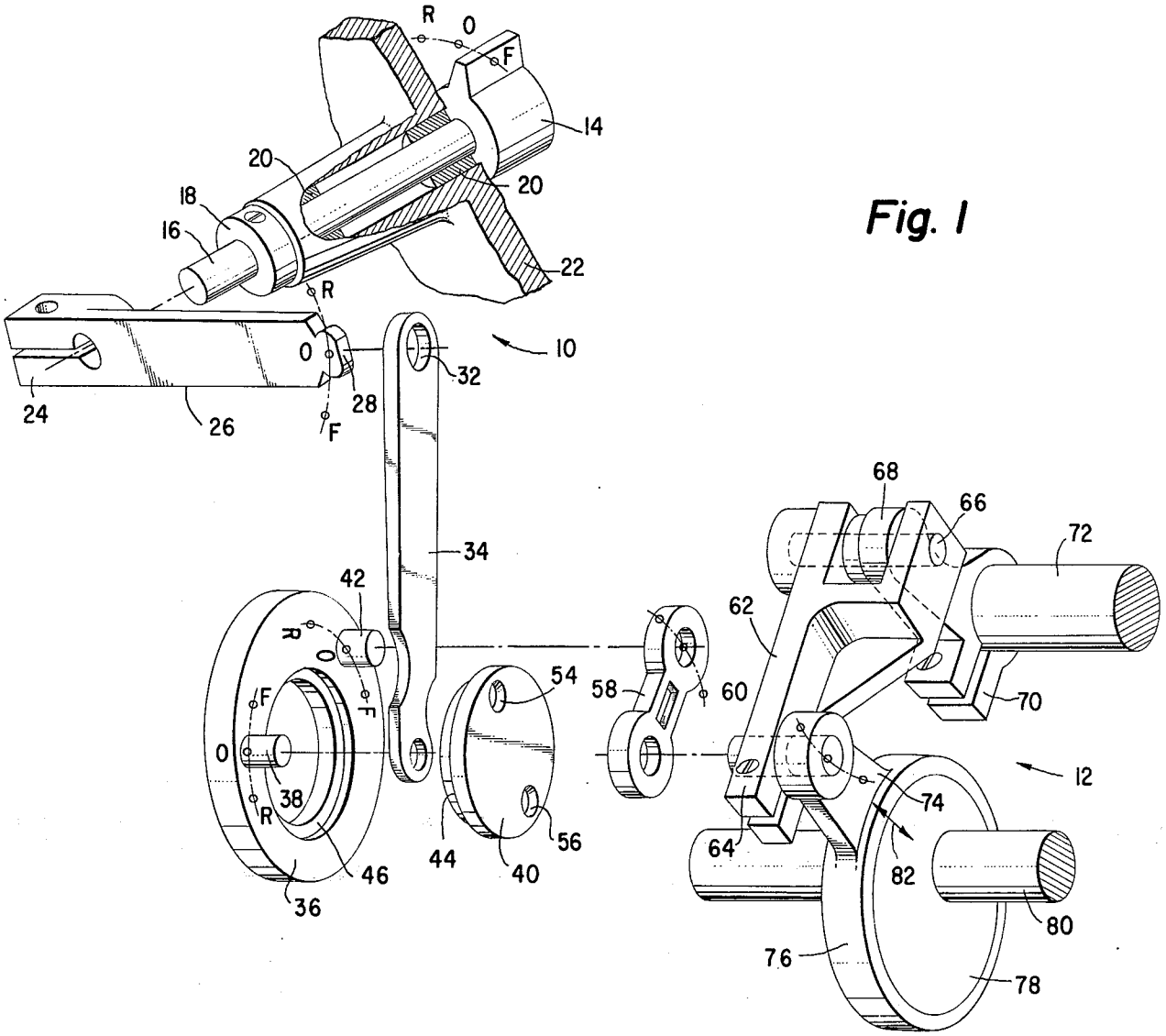
FIG. 1 is an exploded isometric view showing the feeding mechanism constructed in accordance with the teaching of this invention and an associated stitch length regulating mechanism.

Referring now to the drawings, it can be seen that there is shown a stitch length regulating mechanism, indicated in its entirety as 10, connected to and operable on, a drag link feeding mechanism, indicated in its entirety as 12.

The stitch length regulating mechanism comprises a hand operable knob 14 which forms part of a stitch length adjustment control lever for effecting forward and reverse feed of the sewing machine. While in this embodiment, only the forward and reverse knob is shown for the purposes of this disclosure, reference is made to the U.S. Pat. No. 3,082,723 of Backlin which discloses a stitch length control witn an elongate V-shaped opening which is engaged by a pin to provide a predetermined stitch length depending on the position of the pin relative to the apex of the V. In this Backlin patent, a hand operable knob operates to move a pin between two edges of a V for forward and reverse feed while the stitch length remains the same in either feed direction depending on the position of the pin relative to the apex of the V. As in the Backlin patent, the hand operated knob 14 of this invention operates to provide for forward and reverse stitching within a preselected stitch length. Again the aforesaid U.S. Pat. No. 3,082,723, or the U.S. Patent to Sauer et al, U.S. Pat. No. 2,119,492, should be referred to for a more detailed discussion of the interrelationship of these elements of the stitch length regulating mechanism.

The hand operable knob 14 is secured on one end of a shaft 16, which is positioned by collar 18 and suitably journalled in bearings 20 for rotation in frame 22 of the sewing machine. Clamped, as at 24, to the other end of the shaft 16 is an actuating lever 26 responsive to rotation of the knob 14 to pivot at the clamped end about the axis of the shaft 16 to rotate or pivot the other end 28 thereof.

In the embodiment shown, the end 28 of lever 26 may be positioned in three positions, forward F, reverse R, and zero, 0, which represent the direction of movement of a feed dog 30 (FIG. 3) for corresponding movement of the work fabric with the position F and the position R also representing the maximum stitch length and the position 0 representing zero stitch length. As hereinbefore mentioned, the knob 14 and end 28 of lever 26 can be positioned at preselected positions between F-0 and 0-R, respectively, for preselected stitch lengths.

Figure 2:
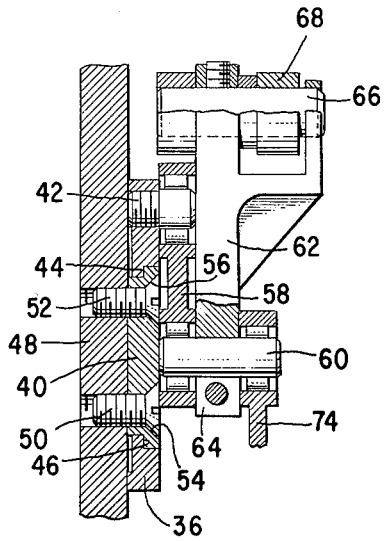
FIG. 2 is a cross-sectional view of the feeding mechanism shown attached to the web of a sewing machine frame.

The free end 28 of lever 26 is toggled as at 32 to a connecting lever 34 which, in turn, is connected to a feed stroke adjusting element in the form of a relatively flat, eccentric, rotatable ring 36 through a connecting pin 38 on ring 36. Thus, movement of the lever 34 rotates the eccentrically mounted ring 36 about its centrally located supporting anchor ring 40 to position a bearing stud 42. The centrally located supporting anchor ring is relatively flat and is nestled within the movable ring 36 and is provided with a flange 44 which engages a counter bore 46 to provide the means for holding the ring 36 and provide a track for rotation therefor. The supporting anchor ring 40 is simply attached to a web 48 (FIG. 2) of the sewing machine by a pair of machine screws 50 and 52 extending through suitable countersunk apertures 54 and 56.

The ring 36 and supporting anchor ring 40 and bearing stud 42 form part of the drag link type feeding mechanism which will now be described.

The bearing stud 42 fixed to the eccentric ring 36 is also jounralled in one end of a lever 58 so as to rotate the lever about a second pivot point embodied in bearing stud 60 and on which the other end of lever 58 is journalled. Thus, the lever 58 is responsive to the three positions of the reversing lever 14, thus far described, through the lever 34 and movement of the bearing stud 42.

The bearing stud 60 is clamped within one end of an arm 62 as at 64, the other end of which is bifurcated to receive both a pivot pin 66 and one end of a rock arm 68 clamped as at 70 to rock shaft 72. Thus, any movement of the arm 62 is imparted to the rock shaft 72. Movement of the arm 62 is accomplished, in the embodiment shown, by having the bearing stud 60, also journalled in one end of a connecting rod 74 which is integral with an outer ring 76. This outer ring encompasses a driving eccentric 78 which is also, in turn, rotated by a main bed shaft 80 fixed to said eccentric. Thus, rotation of the main bed shaft 80 imparts two-directional movement to the connecting rod 74 as indicated by the two-headed arrow 82 but since the bearing stud 60 is also affected by the position of the bearing stud 42 through arm 56, movement of the bearing stud 60 will be in a curved path as shown more clearly in FIG. 3.

Figure 3:
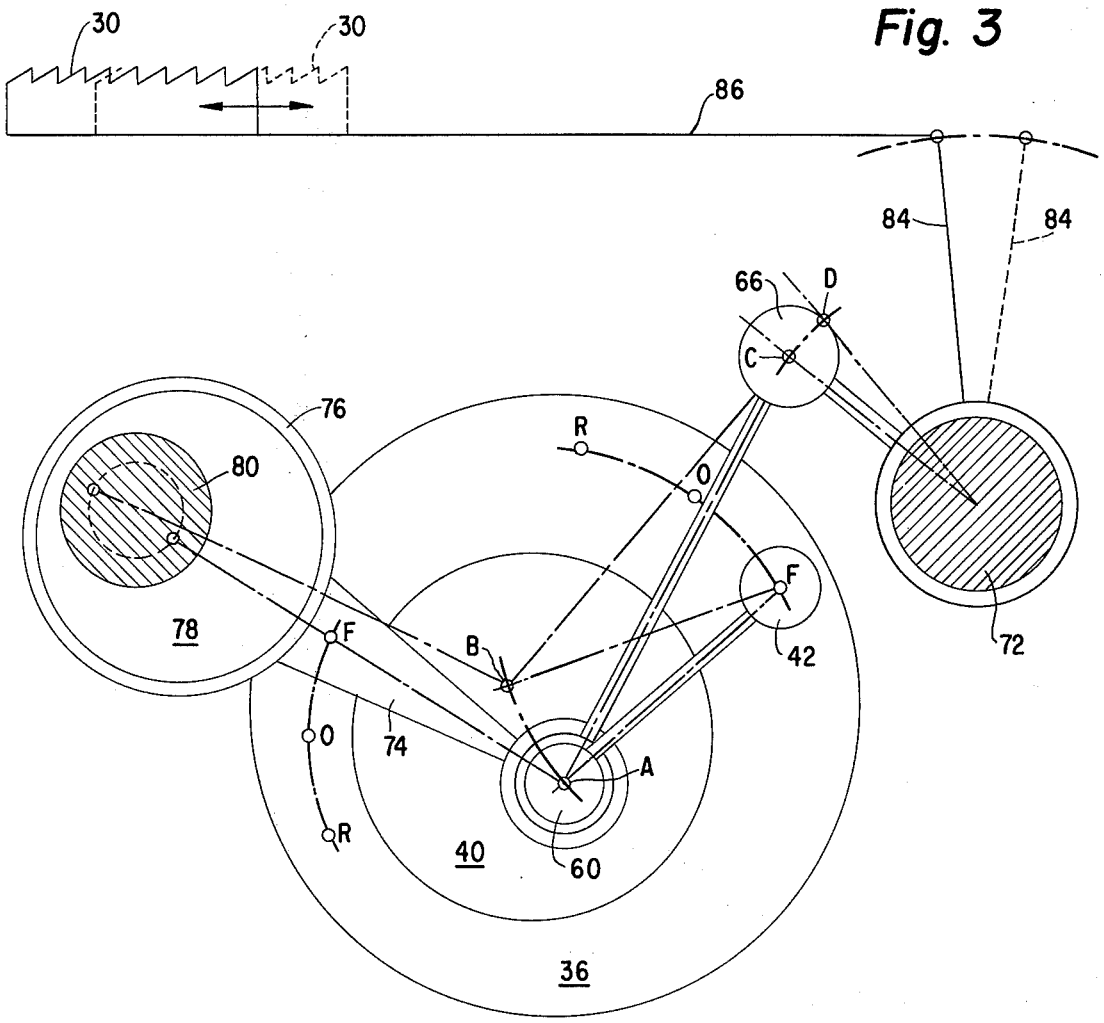
FIG. 3 is a diagrammatic view of the feeding mechanism illustrating the adjustment thereof in different positions.

Turning now specifically to FIG. 3 where the various elements of the drag feed mechanism are shown schematically, it can be seen that, first of all, the feed stroke adjusting element or ring 36 may be positioned by the stitch length control mechanism 10 in a plurality of positions, the maximum stitch length and direction being designated at F and R depending upon the stitch length control mechanism. Thus, the ring 36 can be located in a number of positions between position F, the forward stitch position and R the reverse stitch direction, and the median position 0, the zero stitch length. The particular position of ring 36 locates a corresponding position for the bearing stud 42 which is connected through the link 58 to the second stud 60 directly connected and responsive to the rotation of the main bed shaft 80 through the eccentric ring 76 and connecting rod 74. As shown in FIG. 3, bearing stud 42 is in maximum stitch length forward position, which position also controls the second bearing stud 60 so the latter oscillates between two positions A and B which, in turn, are transmitted to the pivot 66, thus imparting oscillation between positions C and D to rock the rocker arm 68. Rocker arm 68 oscillation, in turn, is imparted to rock shaft 72 and to the crank arm and to the feed bar, both being represented schematically at 84 and 86, respectively, and ultimately the feed dog 30.

As can be seen from a study of this FIG. 3, the position of the feed adjusting ring 36 controls the position of the bearing stud 42 which, in turn, controls the amplitude of oscillation of the second bearing stud 60 to ultimately control the amount of angular sweep of the rock arm 72 which, in turn, is imparted to the feed dog through a feed dog 30.

The operation of the machine can be placed in reverse stitch at the same length conventionally by simply rotating the knob 14, thus placing the bearing stud 42 in a position which is complementary to the same stitch length in the forward direction with the concomitant effect on the bearing stud 60 and the stroke of the feed dog 30.

Zero position of the feed adjusting ring 36 will limit the amplitude of oscillation of bearing stud 60 which will be reflected in the motion of feed dog to simply an up-and-down motion through the throat plate of the machine.

Turning again to FIG. 2, it can be seen that with the disclosed arrangement, the feed mechanism is compact and simply mounted in the machine with the nesting of the supporting anchor ring 40 and stitch adjusting ring 36 the moments of force imposed on the feeding mechanism are reduced and the loads are taken up by larger bearing surfaces. To be noted also from a study of FIG. 2, the various linkages and cams are all situated close together with the link 58 adjacent to the nesting rings 36 and 40 so that one end of the bearing stud 60 is also located adjacent the nesting rings. Thus, the bifurcated arm 62 is as close as possible to the web 48; all of which contributes to the stability and compactness of the mechanism and to the reduction in the moments of force imposed on the various elements.

Finally, it should be understood that while not specifically mentioned above in connection with the Sauer et al U.S. Pat. No. 2,119,492, or the Backlin U.S. Pat. No. 3,082,723, as in these patents the stitch length adjusting mechanism 10 of these inventions may be provided with resilient means to urge the reversing knob 14 in a forward feed position which may be overcome manually, but upon release will immediately return to the forward feed position previously selected. Also, means can be provided whereby the swing of the knob 14 from one position, for example, a forward feed, may be less or greater when in reverse feed, so that a determination of a long stitch length in one direction of feeding and a short stitch length in the opposite direction of feeding may be provided. Obviously, the drag link feeding mechanism 12 will respond according to the position of the knob as described above.

What is claimed is:

1. In a feeding mechanism for sewing machines having a stitch length controlling device which includes means for determining different stitch lengths and the direction of feeding of the work fabric in the sewing machine including means for reversing the direction of the feeding of the work fabrics, a work feeding mechanism comprising a feed dog and means for actuating said feed dog including a rock shaft and a rocker arm for rocking said rock shaft, an arm pivotally connected to said rocker arm, a main drive shaft, a connecting rod operatively connected to said main drive shaft, pivotal connecting means connecting said connecting rod to said arm, whereby rotation of main drive shaft oscillates said pivotal connecting means to thereby rock said rock arm and said rock shaft, means for changing the position of said pivotal connecting means thereby controlling the amount of rocking movement of said rock shaft, said last mentioned means including a stitch length control element operatively connected to said stitch length controlling device with pivot means thereon, an anchor means fixedly attached to the web of the sewing machine and supporting said stitch length control element in rotatable relationship, and linking means attached at one end to the pivot means on said stitch length control element and connected at its other end to said first mentioned pivotal connecting means.

2. The Feeding mechanism as claimed in claim 1 wherein said stitch length control element comprises a ring and said anchor means comprises a ring.

3. The feeding mechanism as claimed in claim 2 wherein said rings are in coplanar nesting relationship with one another.

4. In a feeding mechanism for a sewing machine having a stitch length controlling means with means for establishing the limits of movement of a feed dog and for reversing the movement thereof, a rock shaft and a main bed shaft, a rotatable stitch length control ring connected to said stitch length controlling means and rotatable in response to movement thereof, a supporting anchor ring connected to the bed of the machine, said rotatable stitch length control ring and supporting ring being in nesting relation with one another so that the rotatable stitch length control ring is anchored to said web by said supporting ring, and link means connected to said rotatable stitch length control means and responsive to the action thereof, said link means being connected to a main bed shaft and a rock shaft so that the position of said link means as determined by said stitch length control ring determines the amount of said rock shaft rocks in response to the rotation of said main bed shaft.

5. The feeding mechanism as claimed in claim 4 wherein said linkage means comprises a first link pivoted at one end on said stitch length control ring, a connecting link oscillatable by said main bed shaft and pivotally connected to the other end of said first link, a rock arm fixedly connected to said rock shaft to move in unison therewith, and an arm pivotally connected to said rock arm and to said connecting link so that oscillation of said bed shaft rocks said rock shaft.

* * * * *